United States Patent [19]

Graf et al.

[11] Patent Number: 5,004,170

[45] Date of Patent: Apr. 2, 1991

[54] APPARATUS FOR COMPENSATING SAG OF THE MANDREL OF A WINDING MACHINE

[75] Inventors: Felix Graf; Peter Busenhart, both of Winterthur, Switzerland

[73] Assignee: Maschinenfabrik Rieter AG, Winterthur, Switzerland

[21] Appl. No.: 430,164

[22] Filed: Nov. 1, 1989

[30] Foreign Application Priority Data

Nov. 4, 1988 [CH] Switzerland ..... 4103/88
Jun. 2, 1989 [CH] Switzerland ..... 02079/89

[51] Int. Cl.[5] ..... B65H 54/02; B65H 54/42
[52] U.S. Cl. ..... 242/18 R; 242/18 DD
[58] Field of Search ..... 242/18 R, 18 DD, 65; 403/220, 221, 223, 224, 225, 227

[56] References Cited

U.S. PATENT DOCUMENTS 492,613 2/1893 Pierce ..... 242/18 DD
2,467,548 4/1949 Bradley ..... 403/227
2,772,104 11/1956 Thiry ..... 403/225
2,880,027 3/1959 Everitt et al. ..... 403/224
4,087,055 5/1978 Yasuda et al. ..... 242/18 DD
4,394,985 7/1983 Graf et al. ..... 242/18 DD
4,613,089 9/1986 Munnekehoff ..... 242/18 DD

*Primary Examiner*—Stanley N. Gilreath
*Attorney, Agent, or Firm*—Burns, Doane, Swecker and Mathis

[57] ABSTRACT

A yarn winding machine is equipped to compensate the sag of the spool mandrel (5) with a speedometer roll (7) which is disposed so that it can press radially against the surface of the yarn packages being wound and which is mounted so as to damp vibrations. The mounting for the speedometer roll (7) includes a peg (17) fastened on a yoke (11) which supports the speedometer roll (7). The peg (17) extends into a hole (21) in a carrier (19) for the yoke 11 and is connected to the wall of the hole (21) through O-rings (23) on the surface of the peg (17) so that it is flexible with respect to rotation.

5 Claims, 2 Drawing Sheets

APPARATUS FOR COMPENSATING SAG OF THE MANDREL OF A WINDING MACHINE

FIELD OF THE INVENTION

This invention relates to yarn winding apparatus in which yarn is wound into at least one yarn package carried by a rotatable mandrel and in which a contact roll presses against the outer surface of the yarn package as it is being built up. The invention is concerned particularly with a mounting system for the contact roll capable of permitting changes in the inclination of the contact roll axis in response to operational variations in factors such as the inclination of the mandrel.

BACKGROUND OF THE INVENTION

Winding machines of the type used to build up large packages of synthetic filament yarns typically employ overhung or cantilever mandrels about which the yarns are wound as the mandrels rotate about their axes. Such machines will be referred to here at times as spooling frames and the yarn packages as spools. The cantilever or overhung type mounting for such a mandrel leaves one end of the mandrel free and accessible for the endwise insertion thereover of empty fiber (e.g. paper) tubes onto which the yarn may be wound and for the endwise removal therefrom of the full yarn packages formed as a result of the winding of the yarn onto the fiber tubes.

To reduce vibrations associated with operation of such winding machines or spooling frames at high speeds, the spool mandrels may be mounted elastically. When the weight on such a mandrel is not great, it will be rotated about a generally horizontal axis. However, with spool mandrels which are elastically mounted on the machine at one end only, as is customary for overhung or cantilever mounted mandrels, the spool axis will assume a slanted position as the weight of the spool increases. That is, the free end of the mandrel will shift downwards. Downward shifting of the free end of the mandrel also can be expected in machines wherein the mandrel is not elastically mounted, because the weight of the yarn packages exerts bending forces on the mandrel.

In the absence of other factors, such shifting of the mandrel would affect the relationship between the outer surface of the yarn packages and the contact roll intended to bear thereagainst during the winding operation. In some machines the contact roll is the driving roll for rotating the mandrel through friction with the yarn package on the mandrel. In other machines the contact roll is a speedometer roll which frictionally contacts the outer surface of the building yarn package to sense the peripheral speed thereof and provide an input signal for a drive for the mandrel. In all of these cases, however, it is desirable that the contact roll press with reasonable uniformity against substantially the entire length of all the yarn packages being wound on a mandrel at a given time.

The contact roll ordinarily is disposed above the operative position of the mandrel on which the yarn packages are wound. Its mounting arrangement is such that it may move vertically as necessary in view of the changing diameter of the yarn packages as these are being built up. Means also are provided to press the contact roll downwardly to provide the desired contact with the peripheries of the yarn packages.

During a winding operation, as the weight of the yarn packages on a mandrel increases and the cantilever mounted mandrel consequently sags more and more, there is a tendency for the intended parallelism of the axes of the mandrel and contact roll to be affected adversely. This causes the pressing force of the contact roll against the yarn package to be increasingly reduced towards the free or overhung end of the mandrel.

U.S. Pat. No. 4,087,055 discloses a winder in which the mounting of a contact roll permits some tilting of the contact roll axis in response to sagging of a mandrel axis. In this apparatus a driving roll is mounted pivotably so that it can follow the sloping rotational axis of the spool mandrel as the yarn packages increase in weight.

In order that the driving roll may press with essentially the same force along the entire length of the spool, the roll is moved upwards, radially parallel to the axis of the spool mandrel, as the diameter of the spool increases. For this purpose, it is mounted at both of its ends in a pivotable yoke, which is carried on the machine frame for vertical movement relative to the axis of the mandrel. A spring or the like may bias the pivotable yoke to compensate for the imbalance tendencies associated with the weight of the driving roll and/or its drive motor.

SUMMARY OF THE INVENTION

According to the present invention, a winding machine contact roll is mounted yieldingly so that it may swing and shift slightly during package winding operations to accommodate shifts in the mandrel axis inclination and other irregularities which might interfere with preservation of the desired type of contact between the contact roll surface and the peripheries of the yarn packages being built up on the rotating mandrel. A peg and socket connection is interposed between the contact roll and the carrier which presses the contact roll against the yarn packages, and this connection includes at least one body of resilient rubbery material between the peg and the adjacent socket wall.

The apparatus in accordance with the invention makes it possible to create a pivot bearing for the speedometer roll of a high speed winding machine in an economical fashion. Moreover, this bearing permits not only pivoting motion of the contact roll in either direction of rotation about the pivoting axis, but also radial shifting of the pivoting axis.

In a preferred form of the invention, end portions of a speedometer roll are rotatably mounted in a yoke having a central portion from which a peg extends along an axis generally at right angles to the axis of the speedometer roll. This peg carries at least one O-ring (preferably two O-rings) extending around its axis and contacting the surrounding walls of the socket part of the connection. These O-rings are resilient and can absorb both tangential and radial excursions of the yoke supporting the speedometer roll. They permit operation of the apparatus to remain completely free from maintenance for years. By appropriately varying the number and the pre-tension of the O-rings, the forces involved in the matching of the speedometer roll to the slant of the spool mandrel can be modified as desired.

BRIEF DESCRIPTION OF THE DRAWINGS

The invention now will be explained in more detail with reference to an embodiment illustrated in the accompanying drawings, in which.

DETAILED DESCRIPTION OF PREFERRED EMBODIMENT

Figure 1:
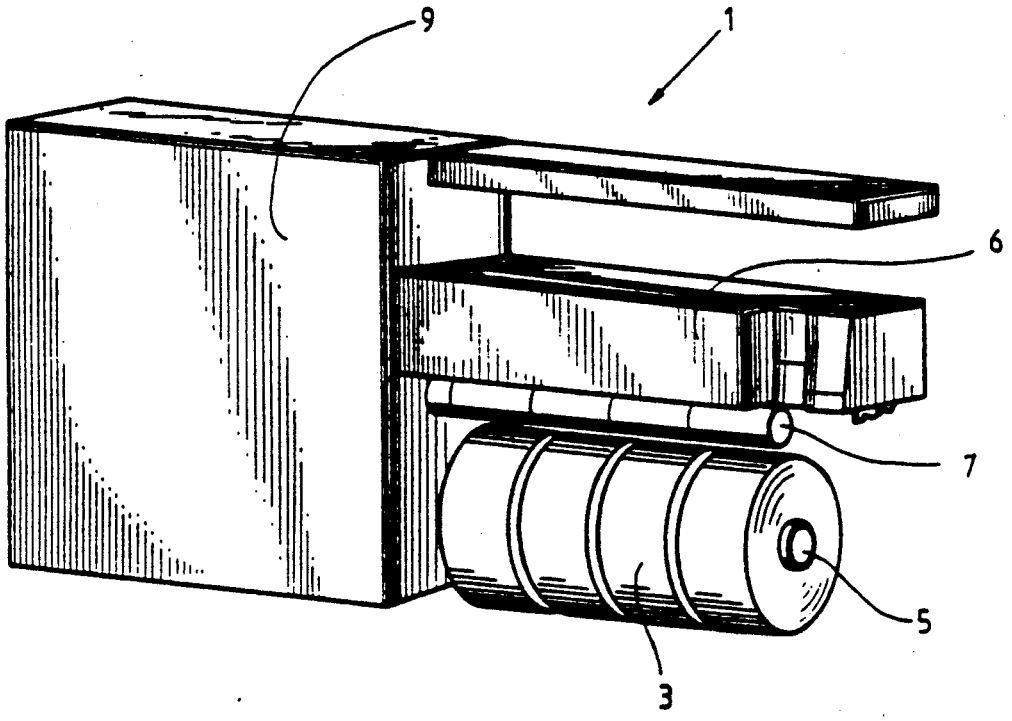
FIG. 1 is a perspective representation of a spooling frame or winding machine embodying the present invention.

The general type of winding machine 1 shown diagrammatically in FIG. 1 should be understood to be representative of both automatic and manual take-up winders employed to form large yarn packages 3 from synthetic filaments. Although only one rotatable mandrel 5 for holding the yarn packages 3 being wound is shown, it should be understood that automatic winding machines of this type frequently include a pair of spool mandrels mounted on a revolving turret so that an inactive mandrel may be moved into an active position to replace a mandrel on which the winding of one or more yarn packages of the desired size has been completed. The full mandrel then may have the yarn packages removed therefrom, and it will remain in an inactive position for a time until the winding of the next yarn packages have been completed.

Whether the machine is equipped with one mandrel or with two turret mounted mandrels, the mount of each mandrel 5 will be one in which the end of the mandrel remote from the mounting structure will be free and unobstructed as shown at the right in FIG. 1. This permits easy insertion over the free end of a mandrel of the empty sleeves (such as paper tubes) onto which the yarns are to be wound and easy removal of the full yarn packages endwise off the free end of the mandrel. The bearings by which the cantilever type of mounting is achieved for each mandrel 5 may if desired be resiliently supported as indicated in U.S. Pat. No. 4,087,055 referred to above. Conventional means on the mandrel hold the sleeves against rotation relative to the mandrel during the winding operations. Automatic doffing apparatus may be employed with such mandrels if desired.

Also indicated in FIG. 1 is a traverse mechanism 6 which is located above the mandrel 5 in position to contact the yarns as they pass from their sources (e.g. from synthetic filament extrusion equipment) into the rotating yarn packages 3. The traverse mechanism 6 moves each yarn back and forth lengthwise of its yarn package 3 to cause a generally level build up of multiple yarn layers within the yarn packages 3. A contact roll 7 also is located above the mandrel 5 for bearing against the surfaces of the yarn packages 3. The mounting means for this roll 7 has been omitted from FIG. 1 but it is disclosed in FIGS. 2 and 3. The mount for the contact roll is carried by winding machine frame or housing 9 as is the support means for the mandrel 5. This machine frame or housing 9 also supports drive motors and control equipment for the winding machine as is customary in such equipment. Only the wall of the housing 9 which faces the winding site is shown in FIG. 2.

It will be understood that the number of yarn packages 3 which may be formed concurrently about a single mandrel 5 is subject to selection in machines of this type. Four side-by-side packages 3 have been indicated in FIG. 1 and two such packages have been depicted in FIG. 2, for example.

Figure 2:
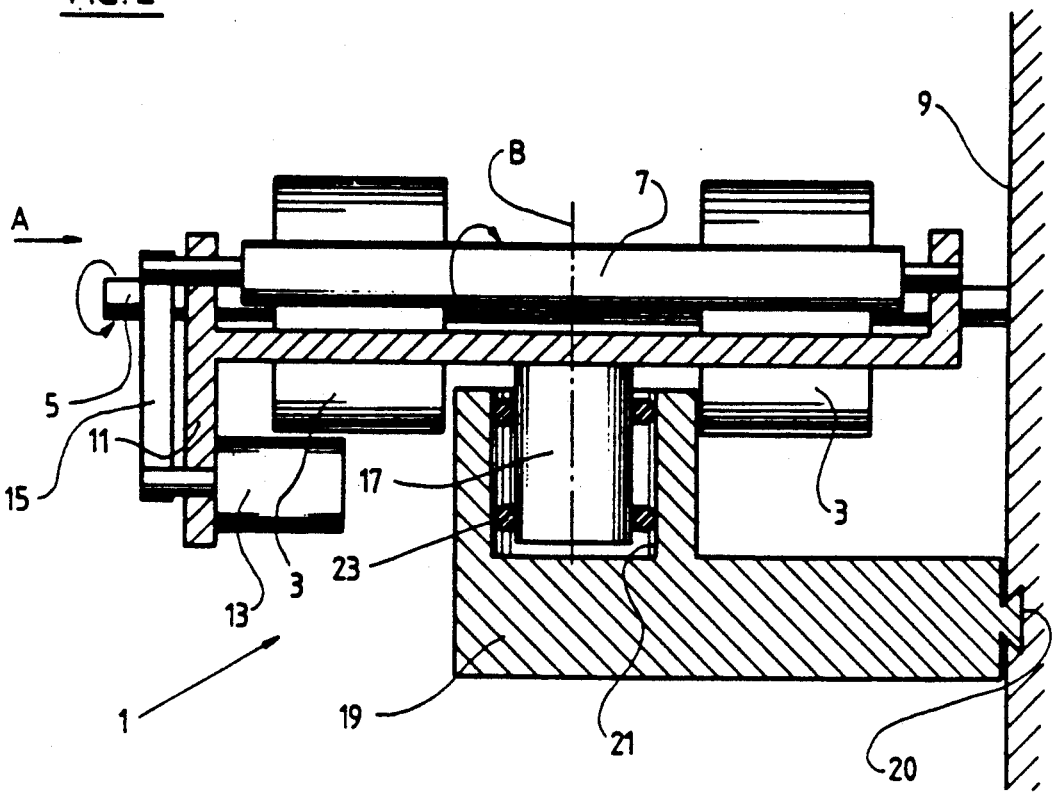
FIG. 2 is a horizontal cross sectional view through the mounting of the speedometer roll of the winding machine of FIG. 1 and looking down on the mandrel therebelow bearing two yarn packages.
Figure 3:
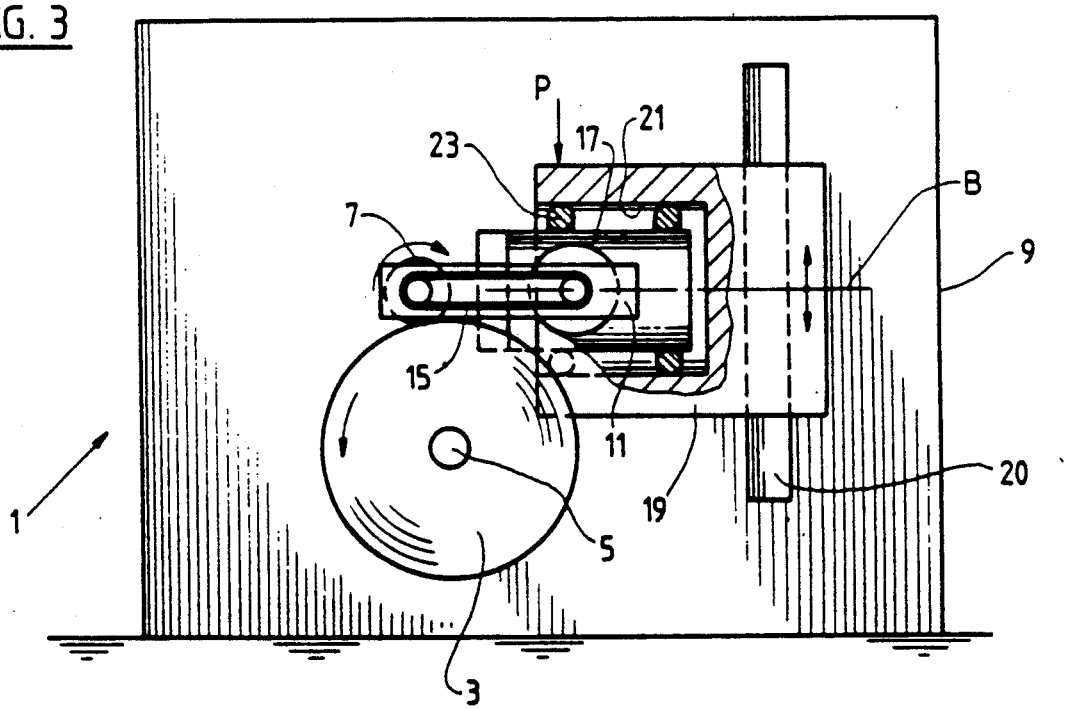
FIG. 3 is a side view (partly cut away) of the apparatus from the direction of arrow A in FIG. 2.

Referring particularly to FIG. 2, it will be seen that the contact roll 7 is disposed above the axis of spool mandrel 5 and parallel thereto. This contact roll 7 is rotatably mounted at both of its ends in a support device or yoke 11. A drive 13 for the roll 7 can likewise be carried by the yoke 11 and can be connected to the speedometer roll 7 by means of a transmission belt 15 so as to drive it.

The yoke 11 is connected to the winding machine frame or housing 9 through a support or carrier 19 mounted for vertical movement on the frame 9 through suitable means which is indicated in FIG. 2 in the depiction there of a dove tail joint 20. As is customary, the carrier 19 will be biassed by some means such as a pneumatic cylinder in a downward direction to press the contact roll 7 toward the surface of the building yarn packages 3.

The pressing forces are transmitted from the carrier 19 to the yoke 11 through the means by which the yoke 11 is connected to the carrier 19. This connection includes a preferably cylindrical peg 17 and a preferably cylindrical socket or hole 21 of a size larger than the peg 17. As illustrated the peg or stub shaft 17 extends generally horizontally from a central portion of the yoke 11 and its axis B may intersect the rotational axis of the contact roll 7. The connection also includes two O-rings 23 which are set on the peg 17 in axially spaced apart relation to one another and which contact the wall of the hole 21 in the carrier 19.

The O-rings 23 are formed of rubber or other resilient material and they are of sizes such that they frictionally engage both the peg 17 and the wall of the socket 21. They should not slip ordinarily with respect to either the peg or the socket but should rather deflect in response to tilting or shifting movements of the yoke 11 in which the contact roll 7 is rotatably mounted. Although O-rings of circular cross-section are quite suitable for use in the present invention, it naturally is also possible to use elastic rubber rings with another cross-section, e.g., an oval or rectangular cross-section.

Instead of establishing the flexible, resilient connection between the yoke 11 and the carrier 19 by the O-rings 23, one could use an insert made of elastic rubber material to fill up the entire intermediate space between the surface of the peg 17 and the surface of the hole 21. However, this approach will not normally be preferred.

The mode of functioning of the apparatus of the present invention now will be evident. At the beginning of a spooling or winding operation, when the spool mandrel 5 is just barely loaded by its own inherent weight and by the weight of the sleeves which take up the spools or yarn packages, the axes of the mandrel 5 and of the speedometer roll 7 will be horizontal and exactly parallel to one another. As the yarn packages 3 build up and increase in diameter and weight, the mandrel 5 will slant downward at its outermost free or overhung end. The contact roll 7 will likewise assume a slanted position with respect to the horizontal through the downwardly pressing force P which is transmitted to the roll 7 through the support 19, the peg 17, and the yoke 11. Of course, when the contact roll 7 is pressed downwardly against the surfaces of the yarn packages 3 on the now tilted mandrel 5, the reaction forces on the two end portions of the contact roll 7 will be out of balance, causing the roll 7 to slant to conform to the slant of the mandrel 5, at which time the reaction forces at different points along the length of the roll will tend to equalize.

The tilting of the contact roll axis is accompanied by a rotary motion of the peg 17 about the axis B (FIG. 2). This rotation of the peg 17 lies within the range of angular minutes. The tangential displacement of the surface of the peg 17 relative to the surface of the hole 21 is accommodated by the elasticity of the O-rings 23 which form the connection between the two surfaces.

After the yarn packages 3 have been completely built up and after the speedometer roll 7 has been lifted from the yarn package surfaces, the yoke 11 and the speedometer roll 7 will be reset to their horizontal starting positions by the resilience of the O-rings 23.

Excursions radial to the speedometer roll, caused by knots in the wound-up yarn, are likewise accommodated and also damped by the elasticity of the O-rings 23, regardless of the slant position in which the speedometer roll 7 is momentarily situated.

Thus, it will be seen that the novel construction of the apparatus of this invention has capabilities for enhancing the performance of yarn winding operations. Although the detailed description has been presented with reference to a particular embodiment, the scope of the invention is to be ascertained from the claims which follow.

What is claimed is:

1. A yarn winding machine comprising a rotatable mandrel for receiving a sleeve onto which the yarn may be wound during rotation of the mandrel to build up a yarn package, said mandrel being supported so as to provide a free end thereof onto which sleeves may be inserted and removed axially of the mandrel;

a contact roll generally parallel to said mandrel for pressing against the yarn package being built up during rotation of said mandrel;

mounting means for rotatably mounting said contact roll; and a carrier for said mounting means, said carrier being movable bodily in a direction to position said contact roll closer to or farther from said mandrel so that said contact roll will continue to contact the building yarn package during a package winding operation, said carrier being connected to said mounting means through a connection that includes a peg projecting from one of said mounting means and carrier, an opening in the other of said mounting means and carrier surrounding and spaced from said peg, and a member of flexible resilient material in surrounding relation to said peg in the space between and contacting said peg and said opening.

2. A yarn winding machine according to claim 1, wherein a plurality of yarn packages are received in side by side relation on said mandrel.

3. A yarn winding machine according to claim 1, wherein said mandrel is generally horizontal and said free end of said mandrel sags downwardly as said yarn package increases in weight, wherein said mounting means includes a yoke for rotatably mounting said contact roll at both of the ends thereof in a position above said mandrel, wherein said peg projects generally horizontally from said yoke along an axis generally perpendicular to the axis of said contact roll, and wherein said member of flexible resilient material is an O-ring.

4. A yarn winding machine according to claim 3, additionally including a second O-ring positioned on said peg at a location spaced axially from the first mentioned O-ring, both of said O-rings frictionally engaging both said peg and said opening and being adapted to flex resiliently to permit limited tilting of said yoke generally about the axis of said peg.

5. A yarn winding machine according to claim 4, additionally including means for applying a pressing force downwardly on said carrier and wherein said pressing force is transmitted to said contact roll through said O-rings.

* * * * *